United States Patent [19]

Harbin et al.

[11] 4,407,203

[45] Oct. 4, 1983

[54] RAILROAD TANK CAR LIFT LUG

[75] Inventors: Wayne D. Harbin; Marvin Stark; Kenneth W. Britt, all of Houston, Tex.

[73] Assignee: Richmond Tank Car Company, Houston, Tex.

[21] Appl. No.: 262,591

[22] Filed: May 11, 1981

[51] Int. Cl.[3] ..... B61K 5/00; B61D 5/00

[52] U.S. Cl. ..... 105/462; 105/1 A; 105/358; 105/362; 414/608

[58] Field of Search ..... 105/1 A, 358, 360, 362, 105/462; 104/32 R, 32 A, 262; 414/608; 254/45, 47

[56] References Cited

U.S. PATENT DOCUMENTS

| | | | |
|---|---|---|---|
| 89,758 | 5/1869 | Fremont | 104/32 R X |
| 127,095 | 5/1872 | Newberry et al. | 104/32 R X |
| 152,873 | 7/1874 | Skinner et al. | 254/45 |
| 728,212 | 5/1903 | Drayer | 105/462 |
| 766,521 | 8/1904 | Randall | 105/355 |
| 1,341,787 | 6/1920 | Drayer | 105/462 |
| 1,433,993 | 10/1922 | Fitch | 212/127 |
| 1,438,341 | 12/1922 | Sjoberg | 104/32 R |
| 1,492,226 | 4/1924 | Sjoberg | 104/32 R X |
| 1,492,227 | 4/1924 | Sjoberg | 104/32 R X |
| 3,251,311 | 5/1966 | Saxonmeyer | 104/32 R |
| 3,752,083 | 8/1973 | Bitterberg | 105/1 A |
| 4,223,612 | 9/1980 | Polley | 105/358 X |
| 4,329,927 | 5/1982 | Minsaull | 105/1 A X |

FOREIGN PATENT DOCUMENTS 481906 8/1929 Fed. Rep. of Germany .

*Primary Examiner*—Randolph Reese

*Attorney, Agent, or Firm*—Pravel, Gambrell, Hewitt, Kirk & Kimball

[57] ABSTRACT

A lift lug for receiving and securing a lifting device to a railroad tank car for re-railing the tank car. The lift lug includes a bolster pad mounted adjacent an end of the tank car and a vertically disposed bolster web, the bolster web having a substantially horizontal extending upper edge. A substantially horizontal base plate is mounted on the extended upper edge of the bolster web with an inner edge of the horizontal base plate secured to the bolster pad. A substantially vertical lift lug plate has its upper edge secured to the bolster pad and its lower edge secured to the base plate. A pair of generally triangular lift lug webs each have their lower edges secured to the base plate, their outer edge secured to the bolster pad. The lift lug plate has an opening adjacent its lower edge.

8 Claims, 5 Drawing Figures

RAILROAD TANK CAR LIFT LUG

TECHNICAL FIELD

This invention relates to railroad tank cars. More specifically, this invention relates to lift lugs for railroad tank cars.

PRIOR ART

Railroad tank cars for transporting liquid and like substances form a major portion of the United States materials transportation system. When a tank car is derailed, it is often necessary to lift the tank car to replace it on the railroad track. This is generally done by cranes which are attached in a number of ways to the tank car and are used to lift the tank car so that it may be maneuvered back onto the track. A railroad tank car is not designed for these types of lift forces and, therefore, may be subject to detrimental forces during re-railing. The potential hazards of the situation are greatly increased when the tank car contains a dangerous cargo.

For these reasons, the Association of American Railroads has required all railroad tank cars built to comply with tank car specifications AAR 24–6 Lifting Provision Test which requires that "after application and release of the required load, visual inspection must reveal no evidence of permanent deformation in the tank car tank, bolster or lifting provision except that local deformation is permitted in the hook bearing area." So far as is known to the inventors, no inexpensive, simple and workable solution to this problem has been found which meets the A.R.R. regulations and ensures the safety of the tank contents.

U.S. Pat. Nos. 89,758; 127,095; 152,873; 766,521; 1,492,226; 1,492,227; 1,438,341; 3,251,311; 3,752,083; and German Pat. No. 481,906 all disclose means for lifting railroad car bodies. None of these patents disclose the use of lift lugs, and with the exception of U.S. Pat. No. 3,752,083, all are designed for fixed placement to unload car bodies and not for re-railing. U.S. Pat. No. 3,752,083 discloses a locomotive bogie having lifting dogs by which the car and truck assembly may be lifted. It does not disclose any means of lifting the car body apart from the truck assembly.

SUMMARY OF THE INVENTION

The present invention is a railroad tank car lift lug for receiving and securing a lifting device to a tank car having a bolster pad mounted adjacent an end of the tank car and a vertically disposed bolster web, the bolster web having a substantially horizontal extending upper edge. A substantially horizontal base plate is mounted on the extended upper edge of the bolster web with an inner edge of the horizontal base plate secured to the bolster pad. A substantially vertical lift lug plate has its upper edge secured to the bolster pad and its lower edge secured to the base plate. A pair of generally triangular lift lug webs each have their lower edges secured to the base plate, their outer edge secured to the lift lug plate and their inner edge secured to the bolster pad. The lift lug plate has an opening adjacent its lower edge.

DESCRIPTION OF THE PREFERRED EMBODIMENT

Figure 1:
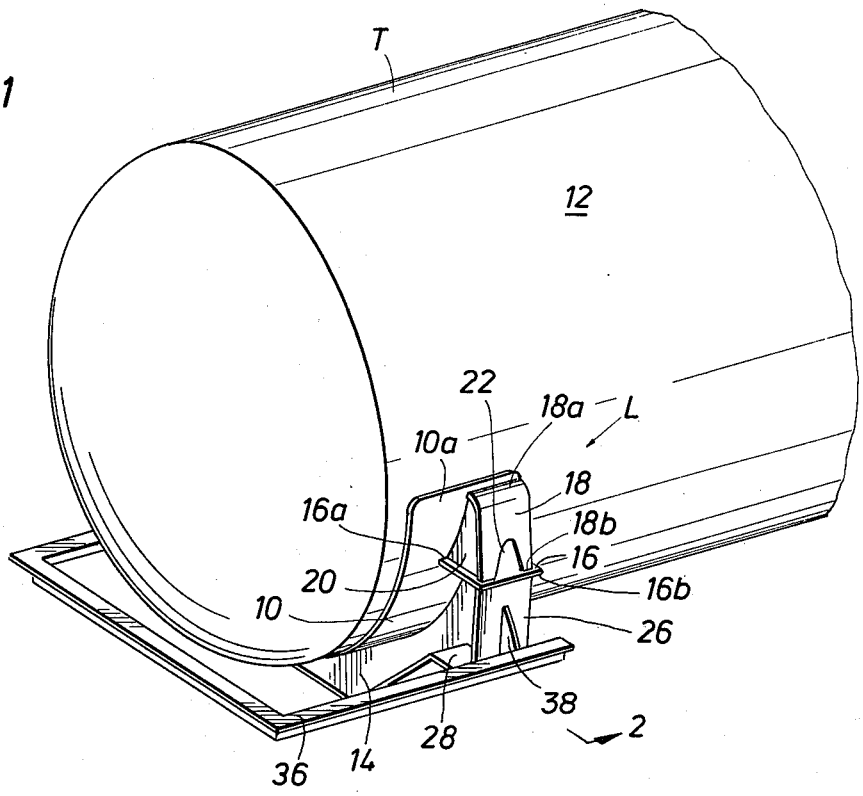
FIG. 1 is a perspective view of a tank car showing the lift lug of the present invention.

In the drawings, FIG. 1 shows a railroad tank car T having a lift lug L of the present invention. A bolster pad 10 is welded to the outer surface 12 of the tank car T. Generally, a similar bolster pad will be mounted at the opposite end (not shown) of the railroad tank car T. A vertically disposed bolster web 14 depends from the bolster pad 10. The bolster web 14 has a horizontally extending upper edge **14*a* on which is mounted a horizontal base plate 16 with an inner edge 16*a* secured to the bolster pad 10. A substantially vertical lift lug plate 18 is secured to the horizontal base plate 16. The lift lug plate 18 has an upper edge 18*a* secured to the bolster pad 10 and a lower edge 18*b* secured to the base plate 16 adjacent the base plate outer edge 16*b*. The strength of the lift lug L is increased by a pair of generally triangular lift lug webs 20 each having a lower edge 20*a* secured to the base plate 16, an outer edge 20*b* secured to the lift lug plate 18 and an inner edge 20*c* secured to the bolster pad 10. Formed in the lift lug plate 18 is an inverted V-shaped opening 22 adjacent to the lower edge 18*b* of lift lug plate 18**.

Thereby is formed a lift lug L of sufficient strength so that a lifting device such as a crane hook may be inserted and secured in the opening 22 and the railroad tank car T may be lifted and re-railed without deformation.

The materials of the lift lug L are preferably steel of sufficient strength for lifting of the tank car T fully loaded. The parts of the lift lug L are preferably welded together and welded to tank car T. Generally each tank car has four similar lift lugs; lift lug L as shown, a lift lug L2 on the opposite side of the tank car T on the bolster pad 10, and two more lift lugs (not shown) similarly situated on a bolster pad on the other end of the tank car T.

Figure 2:
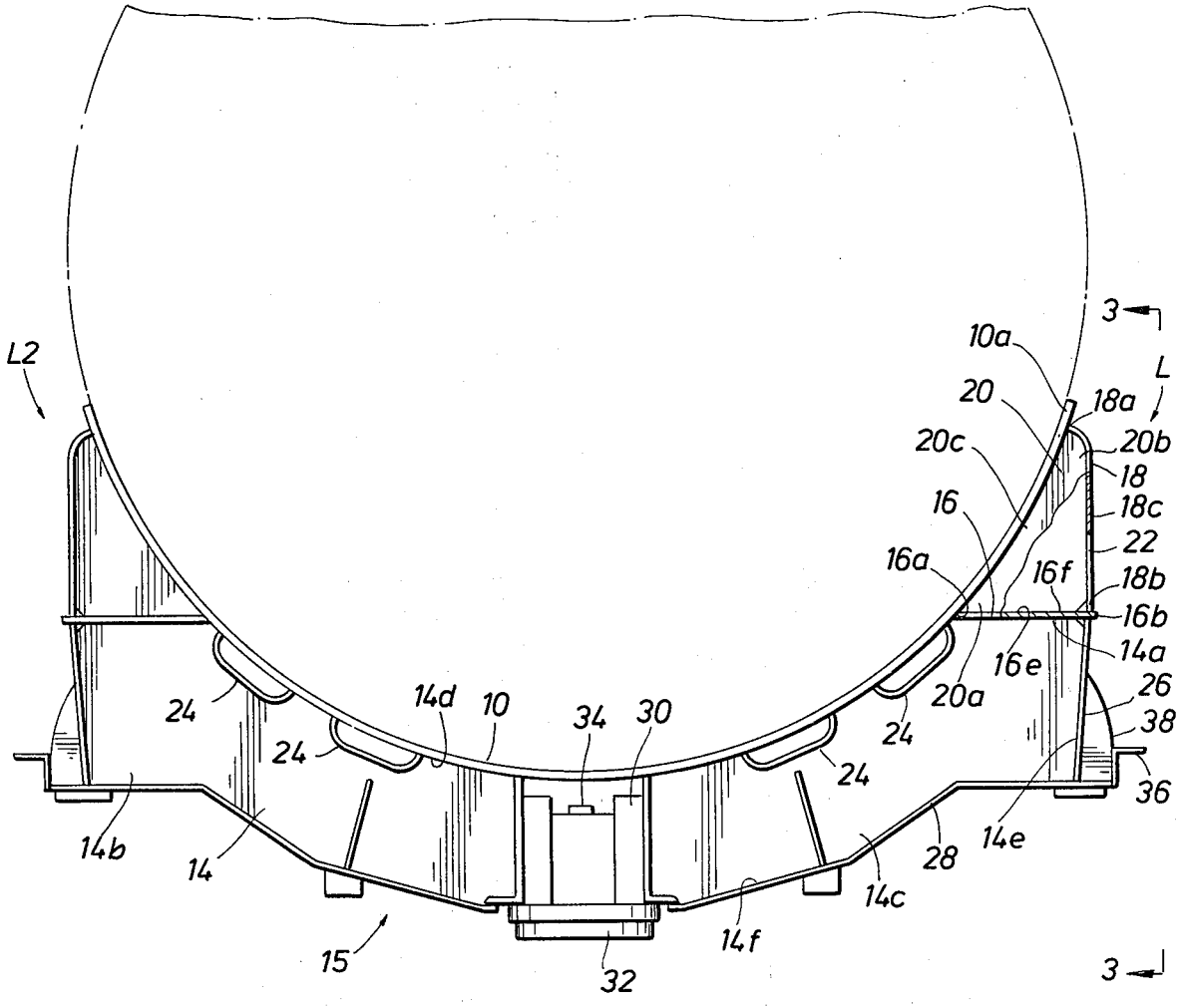
FIG. 2 is an end view of the bolster assembly of FIG. 1 along lines 2—2.
Figure 3:
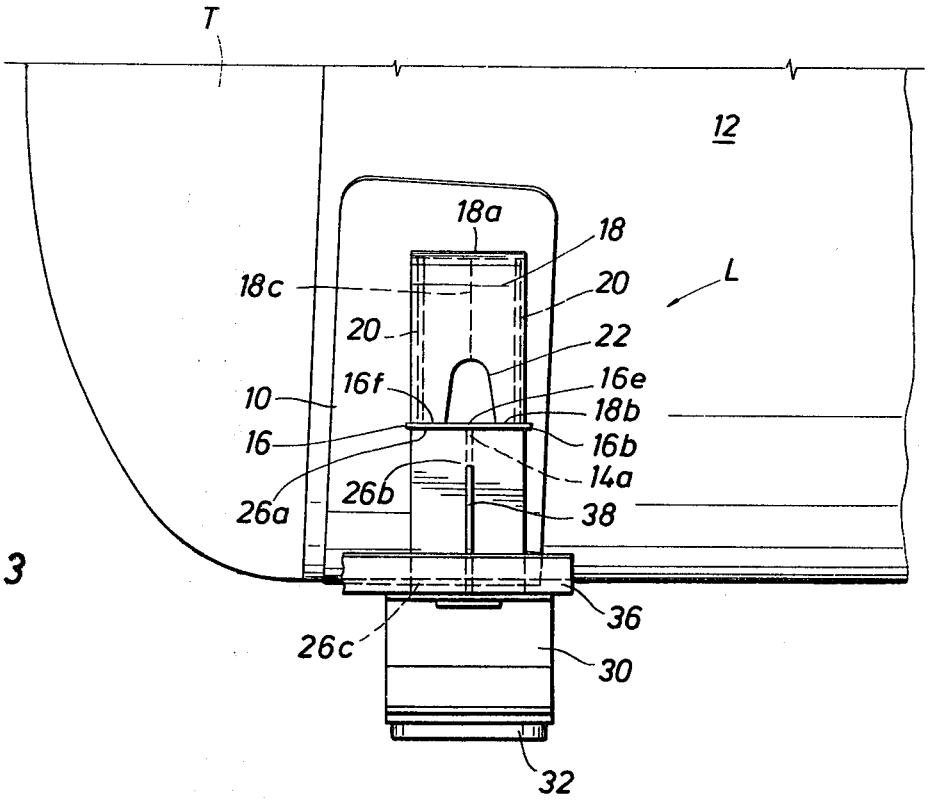
FIG. 3 is a side view of the lift lug assembly along lines 3—3 of FIG. 2.

In more detail, the bolster pad 10 is a generally rectangular steel plate which is curved along its length to conform to the bottom of the outer surface 12 of railroad tank car T. The bolster pad 10 serves to reinforce the railroad tank car T at the point where the weight is carried by a bolster assembly 15. The bolster web 14 as viewed in FIG. 2 is formed with a left portion **14*b* and a right portion 14*c*, generally having mirror symmetry. The bolster web 14 is a vertically disposed plate depending from the bolster pad 10. The main upper edge 14*d* of bolster web 14 is generally contoured to fit the bolster pad 10 with the exception of passages 24 formed in the bolster web 14 to allow cooling coils or electrical wiring to be run through the bolster web 14 along the length of tank car T. Bolster web upper edges 14*a* are generally horizontal and extend out from the bolster pad 10. A bolster assembly is a standard part of most railroad tank cars and if it is desired to retrofit a tank car with the present invention, then its bolster web may be cut to form the desired horizontal extended upper edge 14*a***.

Mounted to the bolster web extended upper edge 14a is the horizontal base plate 16 which is generally rectangular and is mounted along its inner edge 16a (inner referring to the edge nearest the tank car T) to the bolster web 10, and its outer edge 16b (outer referring to the edge furthest from the tank car T) is adjacent the outermost portion of bolster web 14. The base plate 16 is mounted perpendicular to the bolster web upper edge 14a and substantially along the base plate center line 16e to equalize forces during re-railing. Mounted adjacent the base plate outer edge 16b on the base plate upper surface 16f is the lift lug plate 18. Lift lug plate 18 lower edge 18b is welded to the upper surface 16f of base plate 16 adjacent its outer edge 16b and is substantially perpendicular to the base plate 16. The lift lug plate upper end 18a is welded to the bolster pad 10 adjacent the bolster pad end 14a. To increase structural strength, the lift lug plate upper edge 18a is curved so that it joins bolster pad 14 substantially at a right angle.

The pair of substantially identical, generally triangular lift lug webs 20 are each mounted by the inner edge 20c to the bolster pad 10, the lower edge 20a to the base plate 16 and by the outer edge 20b to the lift lug plate 18. One lift lug web 20 is mounted adjacent the forward (forward meaning the end shown in FIG. 1) edges of horizontal base plate 16 and lift lug plate 18 and the other adjacent the rearward (meaning the end not shown in FIG. 1) edges of base plate 16 and lift lug plate 18. Thereby a box is formed by the bolster pad 14, the horizontal base plate 16, the lift lug plate 18 and the two lift lug webs 20. The lift lug plate 18 has formed in it an inverted V-shaped opening 22 adjacent lift lug plate lower end 18b which will accept and secure the lifting device to re-rail the tank car T. In the preferred embodiment, the vertex of the V will be rounded.

The strength of the lift lug L is increased by a generally rectangular side cover plate 26 mounted by its upper edge 26a beneath the base plate outer edge 16b and attached along its center line 26b to the outer edge 14e of bolster web 14. The side cover plate lower edge 26c is mounted to a bottom horizontal member 28 which is mounted perpendicular to the lower edge 14f of bolster web 14.

Other portions of the bolster assembly 15, which are typical features of railroad tank cars, include the center filler box 30 mounted between the left 14b and right 14c portions of bolster web 14 and center plate 32, joined to the bottom of center filler box 30, which rides in the truck assembly (not shown) of the railroad tank car T. A center plate pin 34 extends through the center filler box 30 and the center plate 32 to rotatably guide the tank car T on the truck assembly. An end framing 36, of generally rectangular shape, extends around the tank car T, mounted to the horizontal bolster bottom member 28 and is used for safety purposes on the tank car T. Gusset 38 is mounted between the side cover plate 26 and the end framing 36 to increase structural strength.

Figure 4:
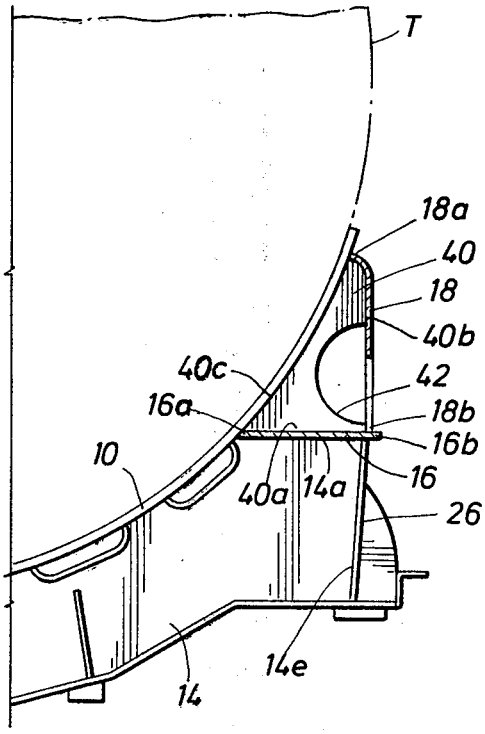
FIG. 4 is an end view of one lift lug of an alternative embodiment of the present invention.
Figure 5:
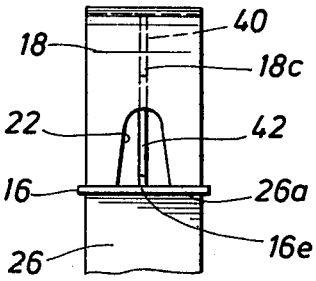
FIG. 5 is a side view of the lift lug of the present invention as shown in FIG. 4.

In an alternative embodiment of the present invention, as shown in FIGS. 4 and 5, using identical numbers for identical parts, a bolster pad 10 is mounted to the outer surface 12 of a tank car T. A vertically disposed bolster web 14 depends from the bolster pad 10. The bolster web 14 has a horizontal upper edge 14a from which is mounted a horizontal base plate 16 with an inner edge 16a secured to the bolster pad 10. A vertical lift lug plate 18 is secured to the horizontal base plate 16. The lift lug plate 18 has an upper edge 18a secured to the bolster pad 10 and a lower edge 18b secured to the base plate 16 along its outer edge 16b. A generally triangular lift lug web 40 has a lower edge 40a secured to the base plate 16, an outer edge 40b secured to the lift lug plate 18 and an inner edge 40c secured to the bolster pad 10. Formed in the lift lug plate 18 is an inverted V-shaped opening 22 adjacent to the lower edge 18b of lift lug plate 18. The lift lug web 40 has formed in its outer edge 40b a semicircular section 42. The opening 42 allows easy placement of a hook through lift lug plate opening 22. The lift lug web 40 is mounted substantially along the center line 18c of lift lug plate 18 and the horizontal plate center line 16e and therefore is substantially coplaner with bolster web 14.

Except for the changed lift lug web 40, the two embodiments are substantially identical. The opening 22 has a rounded vertex. The lift lug plate 18 is curved adjacent its upper edge 18a to meet bolster web 10 at substantially a right angle. A side cover plate 26 is mounted perpendicularly by an upper edge 26a to the base plate outer edge 16b and the bolster web outer edge 14e.

The foregoing disclosure and description of the invention are illustrated and explanatory thereof, and various changes in the size, shape materials as well as in the details of the illustrated construction may be made without departing from the spirit of the invention.

We claim:

1. A railroad tank car lift lug for receiving and securing a lifting device to a tank car, comprising:

a bolster pad mounted adjacent an end of the tank car;

a vertically disposed bolster web depending from said bolster pad, said bolster web having a substantially horizontal extending upper edge;

a substantially horizontal base plate mounted on said extended upper edge of said bolster web with an inner edge of said horizontal base plate secured to said bolster pad;

a substantially vertical lift lug plate with an upper edge secured to said bolster pad and a lower edge secured to said base plate;

a pair of generally triangular lift lug webs each having a lower edge secured to said base plate, an outer edge secured to said lift lug plate and an inner edge secured to said bolster pad; and said lift lug plate having an opening adjacent said lower edge of said lift lug plate.

2. The structure set forth in claim 1, wherein:

said lift lug plate opening has an inverted V-shape.

3. The structure set forth in claim 1, wherein:

said lift lug plate is curved adjacent to said lift lug plate upper edge such that said lift lug plate upper edge is mounted with said bolster web at substantially a right angle.

4. The structure set forth in claim 1, including:

a side cover plate mounted perpendicularly by an upper edge to the outer edge of and below said horizontal base plate and mounted to the outer edge of said bolster web.

5. A railroad tank car lift lug for receiving and securing a lifting device to a tank car, comprising:

a bolster pad mounted adjacent an end of the tank car;

a vertically disposed bolster web depending from said bolster pad, said bolster web having a substantially horizontal extending upper edge;

a substantially horizontal base plate mounted on said extended upper edge of said bolster web with an inner edge of said horizontal base plate secured to said bolster pad;

a substantially vertical lift lug plate with an upper edge secured to said bolster pad and a lower edge secured to said base plate;

a generally triangular lift lug web having a lower edge secured adjacent to the center line of said base plate, an outer edge secured adjacent to the center line of said lift lug plate and an inner edge secured to said bolster pad;

said lift lug web having portions defining a generally semicircular opening adjacent said lift lug web outer edge; and said lift lug plate having an opening adjacent said lower edge of said lift lug plate.

6. The structure set forth in claim 5, wherein:

said lift lug plate has an inverted V-shaped opening.

7. The structure set forth in claim 5, wherein:

said lift lug plate is curved adjacent to said lift lug plate upper edge such that said lift lug plate upper edge is mounted with said bolster web at substantially a right angle.

8. The lift lug assembly of claim 5, including:

a side cover plate mounted perpendicularly by an upper edge to the outer edge of said horizontal base plate and mounted to the outer edge of said bolster web.

* * * * *

UNITED STATES PATENT AND TRADEMARK OFFICE

CERTIFICATE OF CORRECTION

PATENT NO. : 4,407,203

DATED : October 4, 1983

INVENTOR(S) : Wayne D. Harbin; Marvin Stark; Kenneth W. Britt

It is certified that error appears in the above-identified patent and that said Letters Patent are hereby corrected as shown below:

In Column 1, Line 34 A.R.R. should be --A.A.R.--

Signed and Sealed this

*Thirteenth* Day of *March 1984*

[SEAL]

*Attest:*

GERALD J. MOSSINGHOFF

*Attesting Officer*

*Commissioner of Patents and Trademarks*